United States Patent [19]

Arnold et al.

[11] Patent Number: 5,074,013

[45] Date of Patent: Dec. 24, 1991

[54] RELEASABLE SHEAR-RESISTANT FABRIC JOINING APPARATUS

[75] Inventors: Douglas W. Arnold, 5970 Willow Rd., West Bloomfield, Mich. 48033; James A. Brown, 41730-56 Manor Park Dr., Novi, Mich. 48051

[73] Assignees: Douglas W. Arnold; James A. Brown, ; MI Mich. 48051

[21] Appl. No.: 587,756

[22] Filed: Sep. 25, 1990

[51] Int. Cl.[5] ..... A43C 1/00

[52] U.S. Cl. ..... 24/713; 24/306; 24/442; 2/DIG. 6

[58] Field of Search ..... 24/306, 442, 712, 713, 24/713.1, 715.4; 2/DIG. 6

[56] References Cited

U.S. PATENT DOCUMENTS

| | | | |
|---|---|---|---|
| 2,141,801 | 12/1938 | Taft | 24/713 |
| 2,306,515 | 12/1942 | Wright | 24/713 |
| 3,710,425 | 1/1973 | Brumlik | 24/306 X |
| 3,947,928 | 4/1976 | Maldonado | 24/713 |
| 4,247,967 | 2/1981 | Swinton | 24/713 |
| 4,270,285 | 6/1981 | Antonious . | |
| 4,275,513 | 6/1981 | Antonious . | |
| 4,282,657 | 8/1981 | Antonious . | |
| 4,308,672 | 1/1982 | Antonious . | |
| 4,514,882 | 5/1985 | Lavielle | 24/712.1 X |
| 4,764,119 | 8/1988 | Miraglia | 24/712 X |
| 4,776,068 | 10/1988 | Smirlock et al. | 24/306 X |
| 4,842,522 | 6/1989 | Alexander et al. | 24/712 |
| 4,930,196 | 6/1990 | Laurin | 24/715.4 |

*Primary Examiner*—Werner H. Schroeder
*Assistant Examiner*—Jeanette E. Chapman
*Attorney, Agent, or Firm*—Mason, Fenwick & Lawrence

[57] ABSTRACT

A releasable fabric joining apparatus is disclosed, comprising a first piece of material which includes a planar body substrate and a planar loop substrate which has a first loop substrate secured coplanar with the planar body substrate. The planar loop substrate also includes a second loop substrate surface formed of woven fabric having plural loops of thread. A second piece of material forms another part of the apparatus, and has at least one surface with a grip face provided with plural, outwardly-extending filamentary hooks releasably received by the plural loops of thread. In a preferred embodiment, the first piece of material is woven fabric, and the second piece of material is loop-type Velcro. The present invention may be used in many different embodiments, such as in a non-slip shoelace, baby bib, and in other applications wherein a need exists to releasably secure to pieces of fabric while ensuring that the joined pieces have high resistance to shear stress.

15 Claims, 1 Drawing Sheet

20
16
10
34
12
11
18
22
60
61
58
62
60
18
30
22
26
50
54
52
53
59
58
32
26
16
20
24
30
22
18
11
28
32
10
12
34
14
100
102
108
106
103
114
104
110
112
400
414
412
408
406
410
403
416
418
417
404
402
403

RELEASABLE SHEAR-RESISTANT FABRIC JOINING APPARATUS

BACKGROUND OF INVENTION

1. Field of the Invention

The present invention relates generally to shear-resistant apparatus for joining planar woven materials such as fabric used in shoe closures. The present invention relates specifically to means and apparatus for joining two pieces of fabric wherein one piece of fabric is provided with a filamentary hook gripping surface for releasable coupling with a woven surface of the second piece of fabric.

2. Prior Art

The technology underlying design of shoe soles and uppers has progressed significantly in the recent past, but little progress has been made in designing suitable closures for shoes which prevent accidental opening of the closure, thereby allowing the foot to slip out of the shoe. Since the invention of shoelaces and buckle clasps for shoes, few other methods of closure have been attempted. The invention of material sold under the trademark Velcro, a two-part securement means comprising a first surface provided with plural filamentary hooks and a second surface provided with plural filamentary loops which engage the hooks, has permitted further advancement in the technology of shoe closures Development of most prior shoe closures has focused on the structure of the closure straps rather than the placement of the Velcro strips or other fastening means. For example, U.S. Pat. No. 4,275,513 (Antonious) discloses a shoe having separable fastening members coacting with flexible gripping elements such as hook and loop Velcro-type fasteners. The location and structure of the separable fastening members enables a person having only one arm, or an artificial limb, to secure the closure with one hand.

Similarly, U.S. Pat. No. 4,282,657 (Antonious) discloses a heel restraint secured by an adjustable, flexible closure assembly using two-part hook and loop Velcro fastening surfaces. Prior to these inventions, an adjustable and flexible shoe closure was developed, enabling the wearer to pull the uppers of the shoe inwardly and fasten the shoe using only one hand. Such a closure preferably uses two-part Velcro-type fasteners, as disclosed in U.S. Pat. No. 4,270,285 (Antonious).

The foregoing references demonstrate the use of two-part Velcro with strap-type fasteners for shoes. However, such fasteners have significant aesthetic and functional drawbacks which limit their application. For example, some shoe designers consider that the strap-type fasteners used in the Antonious references have a "clunky" appearance which is undesirable from an aesthetic point of view.

An attempt has been made to combine the attractive aesthetic features of traditional shoelaces with a slip-resistant binding, as disclosed in U.S. Pat. No. 4,247,967. The Swinton disclosure relates to providing a shoelace with hook and loop Velcro surfaces so that a hook surface provided on one end of the shoe lace mates with a loop surface provided on a second end of the shoe lace. Thus, when the shoe lace is tied in a traditional bow knot, at least one portion of each Velcro loop gripping surface will co-act with a portion of an oppositely configured Velcro hook surface. This results in a shoelace knot having high shear strength and resistance to slippage.

Unfortunately, Swinton requires providing a shoelace with both a hook and a loop Velcro surface, a process which is difficult to manufacture and requires a significant amount of materials and additional manufacturing efforts, since different types of Velcro material must be secured to the shoelace.

In contrast, the present invention takes advantage of the natural filamentary loop properties of a typical woven fabric shoelace. Specifically, the present invention recognizes that a hook-type Velcro surface will easily mate with a variety of woven fabrics, since such fabric inherently includes a plurality of tightly connected thread loops which form the fabric. Thus, when the filamentary hooks of a first Velcro surface are brought into contact with a woven fabric shoelace, the hooks will engage the thread loops of the woven fabric, thereby coupling the pieces together.

Such an arrangement manifests the same high resistance to shear stress exhibited by traditional two-part Velcro having a hook surface and a loop surface. However, the inventive arrangement does not require purchasing the loop segment of Velcro and separately securing it to the shoelace or other fabric. Thus, the inventive apparatus costs significantly less than competing methods and requires fewer materials and manufacturing costs. The present invention also does not require alignment between Velcro hook and loop surfaces, since the filamentary hooks of the present invention will couple with loops in the fabric regardless of the location on the fabric touched by the hooks.

Thus, the prior art appears deficient in not providing means for joining two fabric segments in an arrangement having high resistance to shear stress, while permitting easy separation of the fabric elements when desired.

SUMMARY OF THE INVENTION

The above-noted shortcomings of the prior art are avoided by the present invention by providing a releasable fabric joining apparatus comprising a first piece of material which includes a planar body substrate and a planar loop substrate. A first loop substrate is secured coplanar with the planar body substrate. The planar loop substrate also includes a second loop substrate surface formed of woven fabric having plural loops of thread. A second piece of woven fabric material forms another part of the apparatus, and has at least one surface with a grip face provided with plural, outwardly-extending filamentary hooks releasably received by the plural loops of thread. In a preferred embodiment, the first piece of material is woven fabric, and the second piece of material is loop-type Velcro. The present invention may be used in many different embodiments, such as in a non-slip shoelace, a baby bib, and in other applications wherein a need exists to releasably secure two pieces of fabric while ensuring that the joined pieces have high resistance to shear stress.

Thus, one object of the present invention is provision of apparatus for joining two pieces of fabric which permits easy release of the two fabric pieces while providing high resistance to shear loads.

Another object of the present invention is provision of releasable fabric joining apparatus in which hook-type Velcro or another filamentary hook surface engages the filamentary loops naturally provided in woven fabric, such that the apparatus requires only a single Velcro surface.

A further object of the present invention is to provide a slip-resistant binding for shoes in which a first filamentary hook surface engages the woven material from which the lace is formed.

Yet another object of the present invention is to provide a bib or other releasable fabric construction in which a first filamentary hook surface engages the filamentary loops found in the woven material.

The foregoing objects, and other objects, will become apparent when the following discussion is taken in conjunction with the drawings.

DETAILED DESCRIPTION OF PREFERRED EMBODIMENT

Figures 1, 2, 2A, 3, 4:
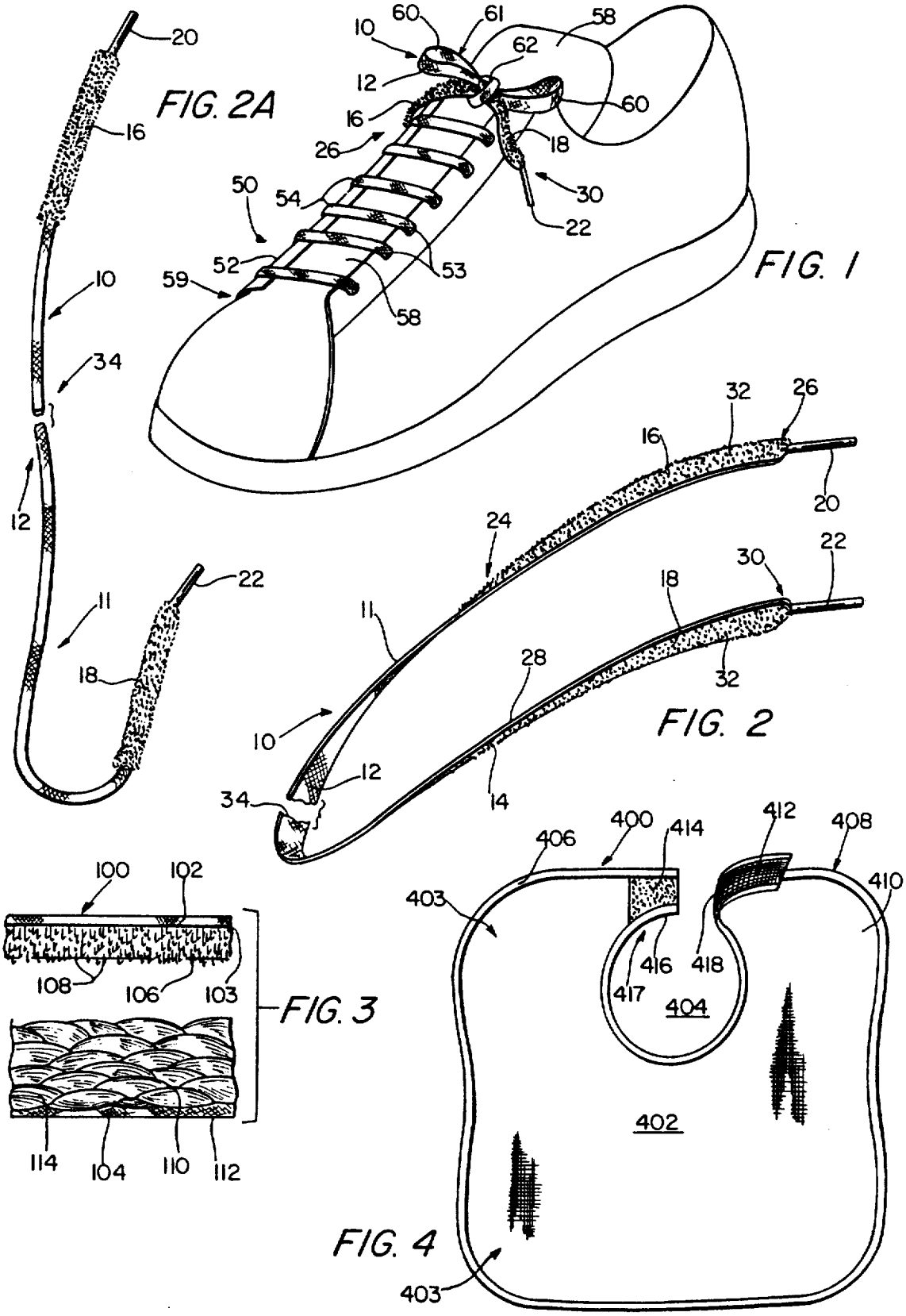
FIG. 1 is a perspective view of a shoe incorporating a slip-resistant shoelace according to a first embodiment of the present invention.
FIG. 2 is a perspective view of a shoelace according to the first embodiment of the present invention.
FIG. 2A is a perspective view of a shoelace according to the second embodiment of the present invention.
FIG. 3 is a magnified elevation view of a portion of the hook and loop surfaces of the shoelace of FIG. 2.
FIG. 4 is a top plan view of a second embodiment of the present invention, in which the gripping members of the apparatus are disposed on a bib.

In the following description specific terminology is used for the sake of clarity. However, the invention is not intended to be limited to such terminology, but rather the invention includes all technical equivalents operating in a substantially similar manner to achieve substantially similar results.

Referring generally to FIGS. 1 through 4, and referring to a first embodiment of the present invention shown in FIGS. 1 and 2, a slip-resistant shoelace 10 according to the present invention is shown in FIG. 2. The shoelace 10 comprises an elongated strip of material 11 having a first fabric face 12 and a second fabric face 14. The shoelace 10 is provided with a first end 25 and second end 29, which ends 25 and 29 terminate in aglets 20 and 22. The aglets 20 and 22 may include transparent tape or other plastic or metal means for preventing the ends 25 and 29 of fabric strip 11 from fraying or unraveling during use.

The shoelace 10 is further provided on one face with two strips of hook material 16 and 18. The strips 16 and 18 preferably comprise the hook-type part of conventional connector means sold under the trademark Velcro, but may comprise other filamentary engagement means having a plurality of small, flexible hooks 32 protruding upwardly from the surface of the shoelace 10. As further shown in FIG. 2, the hook face 16 includes a first end 24 disposed along the longitudinal axis of shoelace 10, and a second end 26 located adjacent to termination means 20. Similarly, hook face 18 includes a first end 28 located adjacent to aglet means 22.

In alternative embodiments the strips 16 and 18 may comprise plural spaced-apart subsections of "Velcro" type connectors or other filamentary hook material. Further, strips 16 and 18 may be secured to shoelace 10 at any desired point along the length of strip 11; strips 16 and 18 need not necessarily be located near the ends of lace 10.

As is known in the prior art, the shoelace 10 may be provided in any length suitable for the shoe for which it is to be used; accordingly, FIG. 2 includes a breakpoint 34 to indicate that the shoelace 10 could be of any desired length. Moreover, the length of strips 16 and 18 is not critical, but to provide sufficient gripping area, strips at least one inch in length are preferred.

As shown in FIG. 1, shoelace 10 may be incorporated in any standard shoe 50 of a desired design. The shoe 50 of FIG. 1 includes two uppers or shoe sides 52, a toe piece 56, and a tongue 58 which together define the front or nose portion 59 of the shoe. Uppers 52 are provided with plural holes 53 throug which shoelace segments 54 are threaded. Segments 54 are visible portions of a shoelace 10 of FIG. 2 which shoelace 10 has been threaded through holes 53 in known manner.

Ordinarily, to secure the lace 10 the ends of the lace 54 will be tied in a standard bow knot 61, which comprises a pair of spaced-apart bow loops 60, and a central knot section 62. The ends 26 and 30 of shoelace 10 protrude outward from the bow knot. Ends 26 and 30 are provided with hook-type Velcro gripping surfaces 16 and 18, as shown in FIG. 2. When the knot 61 is suitably tied, at least a portion (not shown) of the Velcro ®type grip surfaces 16 and 18 will be located underneath and within the central knot 62. This arrangement forces the filamentary hooks of surfaces 16 and 18 to contact and couple with the shoelace fabric located inside knot 62. When surfaces 16 and 18 co-act with the fabric interior of knot 62, the hooks provided in hook surfaces 16 and 18 will mate with the fabric surface or opposing hook surface of the shoelace 10 within knot 62. This results in a coupling of the hooks and the fabric of shoelace 10 in a manner similar to the coupling of the hook portions and loop portions of ordinary Velcro ® type connectors.

FIG. 3 shows in enlarged detail the facing surfaces of the components 100 for joining fabric according to the present invention. The components include a first fabric substrate 102, which generally comprises a planar backing surface 103 to which a hook face 106 is secured. The assembly further comprises a second fabric substrate 104 to which is secured facing surface 110, which may comprise any conventional woven fabric. The fabric 110 may comprise fabric of any desired configuration, organic or inorganic, natural or synthetic, provided that the fabric 110 includes plural, interwoven filaments 114 which form flat loops when woven into surface 110.

Hook face 106 includes plural small filamentary hooks 108 which protrude downwardly from the hook face 106 and from substrate 102. When substrate 102 and substrate 104 are brought into close alignment, the hooks 108 engage individual loops in the facing fabric surface 110, thereby coupling the surfaces together.

As is known in the prior art concerning Velcro type connectors, a coupling arrangement of the filamentary hook and loop type exhibits extremely high shear strength, and relatively little lateral breakage strength. Thus, the surfaces 108 and 110 may be quickly and easily separated by pulling in a direction perpendicular to one surface or the other. In contrast, the surfaces 106 and 108 will not easily separate when pulled laterally such that a shear load is exerted on the hooks 108 or the fabric surface 110.

An alternative embodiment of the present invention is shown in FIG. 2A which depicts a cylindrical shoelace 10 having a cylindrical woven body 12 which may take the form of a conventional dress- or boot-style shoelace.

Body 12 may comprise any suitable woven shoelace material providing a sufficient number of thread loops to effectively grip the Velcro surfaces 16 and 18 on the body 12. In a fashion similar to the embodiment of FIG. 2, shoelace 10 of FIG. 2A is provided with aglets 20 and 22 at either end of shoelace 10. Velcro surfaces 16 and 18 are provided at either end of the shoelace 10, and the length of surfaces 16 and 18 is not critical. The shoelace 10 of FIG. 2A may be constructed in any desired length as indicated by the break line 34 of FIG. 2A. In the embodiment of FIG. 2A, Velcro surfaces 16 and 18 wrap entirely around the cylindrical body 12.

A further alternative embodiment of the present invention is shown in FIG. 4, and involves the application of the hook surfaces and fabric surfaces of FIG. 3 to a detachable bib 400. As shown in FIG. 2, a bib 400 preferably comprises a generally rectangular bib body 402 including an upper bib body portion 403 and a lower bib body portion 403'. Upper bib body portion 403 includes two inwardly-extending neck arms 416 and 418. Arms 416 and 418 define an upper aec 417 of a neck hole 404 in bib 400. Hole 404 receives the neck of a coiled or adult when the bib 400 is placed around the neck of the person. In such an arrangement, bib arms 414 and 418 are clasped together at the nape of the neck of the person wearing the ib.

In the embodiment of FIG. 4, the first neck arm 416 is provided with a hook face 414 on one surface of neck arm 416. the hook face comprises plural filamentary hook elements such as hooks 108 shown in FIG. 3, or the hook portion of conventional Velcro® type material. The underside of neck arm 418 is preferably provided with a grip area 412. Area 412 comprises the same woven fabric which is used to construct the rest of bib 400. Thus, when the bib is clapsed around the neck of an individual, the fabric facing surface 412 is brought into contact with the hook surface 414, thereby mating the surfaces together. In such an arrangement, the protruding filamentary hooks of surface 414 are coupled with the woven fabric surface 412, providing a secure fit between arms 416 and 418.

In alternative embodiments, surface 416 may be provided only with a facing fabric surface, and arm 418 or its under surface may be provided with plural filamentary hooks, or a conventional hook segment of Velcro.

The foregoing teachings of the present invention may be practiced otherwise than as specifically described. For example, the apparatus of FIG. 3 may be adapted to any number of other applications in which it is desired to join two fabric surfaces without using a loop portion of Velcro. Specific applications contemplated include securement of the cuffs of sleeves, temporary securement of parts of rental costumes or formal wear, securement of neckties to the front of a shirt when worn, and securement of the waistbands of trousers, skirts, and the like. thus, the scope of the invention is not limited by the foregoing specification, and the invention may be practiced otherwise than as described, within the scope of the appended claims.

We claim:

1. A shear-load resistant shoelace comprising:

an elongated shoelace body having first and second longitudinal ends, upper and lower opposite surfaces and first and second opposing edges, said body comprising woven fabric having plural loops of thread;

wherein at least one of said first and second ends includes at least one surface having a grip face with plural outwardly-extending filamentary hooks capable of being releasably received by said plural loops of thread without engaging a separate loop-type fastener, wherein, when said ends of said shoelace are intertwined by knotting, at least a potion of said hooks engage at least one of:

a portion of said loops of said woven fabric, and a portion of said filamentary hooks;

said engaged loops being located on at least one of;

said upper surface on said first longitudinal end;

said upper surface on said second longitudinal end;

said lower surface on said first longitudinal end;

said lower surface on said second longitudinal end;

said first edge on aid first longitudinal end;

said fist edge on said second longitudinal end;

said second edge on said first longitudinal end; and said second edge on said second longitudinal end.

2. The shoelace of claim 1, wherein both said first and second ends include at least one surface having a grip face with plural outwardly-extending filamentary hooks releasably received by said plural loops of thread.

3. The shoelace of claim 1, wherein both said fist and second ends include upper and lower end surfaces each having a grip face with plural outwardly-extending filamentary hooks releasably received by said plural loops of thread.

4. The shoelace of claim 1, wherein said first and second ends each terminate in means of retaining and protecting a fabric lace end.

5. The shoelace of claim 1, wherein aid grip face comprises a piece of VELCRO brand hook material.

6. The shoelace of claim 2, wherein said grip face comprises a piece of VELCRO® rank hook material.

7. The shoelace of claim 3, wherein said gripe ace comprises a piece of VELCRO® brand hook material.

8. A shear-load resistant shoelace comprising:

an elongated shoelace body having first and second longitudinal ends and a cylindrical exterior shoelace surface, and comprising woven fabric having plural loops o thread;

wherein at least one of said first and second ends includes a cylindrical grip face with plural outwardly-extending filamentary hooks capable of being releasably received by said plural loops of thread; and wherein, when the ends of said shoelace are intertwined by knotting, said filamentary hooks do not engage a separate loop-type fastener.

9. The shoelace of claim 8, wherein both said first and second ends include a cylindrical grip face with plural outwardly-extending filamentary hooks releasably received by said plural loops of thread.

10. The shoelace of claim 8, wherein both said first and second ends include upper and lower end surfaces each having a grip face with plural outwardly-extending filamentary hooks releasably received by said plural loops of thread.

11. The shoelace of claim 8, wherein said fist and second ends each terminate in means for retaining and protecting a fabric lace end.

12. The shoelace of claim 8, wherein said grip face comprises a piece of VELCRO brand hook material.

13. The shoelace of claim 9, wherein aid ripe ace comprises a piece of VELCRO® brand hook material.

14. The shoelace of claim 10, wherein said grip face comprises a piece of VELCRO® brand hook material.

15. A shear-load resistant shoelace consisting essentially of:

an elongated shoelace body having first and second longitudinal ends, said ends having upper and lower opposite surfaces and opposing edges, said body comprising woven fabric having plural loops of thread;

wherein sat least one of said surfaces and edges on said first and second ends includes at least one grip face with plural outwardly-extending filamentary hooks capable o being releasably received by said plural loops of thread; and wherein said ends of said shoelace are intertwined by knotting.

* * * * *